US007713220B2

(12) United States Patent
Chen

(10) Patent No.: US 7,713,220 B2
(45) Date of Patent: May 11, 2010

(54) MULTIPLE MODE MASSAGE CHAIR

(76) Inventor: Samuel Chen, Flat M, 3 floor, Kaiser Estate Phase 3 Hok Yuan Street, Kowloon, Hong Kong (CN)

( * ) Notice: Subject to any disclaimer, the term of this patent is extended or adjusted under 35 U.S.C. 154(b) by 792 days.

(21) Appl. No.: 11/651,860

(22) Filed: Jan. 10, 2007

(65) Prior Publication Data

US 2008/0167587 A1 Jul. 10, 2008

(51) Int. Cl.
*A61H 15/00* (2006.01)

(52) U.S. Cl. ..... 601/99; 601/98; 601/101; 297/284.9

(58) Field of Classification Search ..... 601/10–103, 601/115, 146; 297/284.9, 219.1, 219.11, 297/223, 230.1
See application file for complete search history.

(56) References Cited

U.S. PATENT DOCUMENTS 3,675,644 A * 7/1972 Laskowitz ..... 601/115
5,247,925 A * 9/1993 Yamasaki et al. ..... 601/49
5,868,687 A * 2/1999 Tedesco ..... 601/49
5,976,097 A * 11/1999 Jensen ..... 601/98

* cited by examiner

*Primary Examiner*—Quang D Thanh
(74) *Attorney, Agent, or Firm*—Clement Cheng

(57) ABSTRACT

A multiple mode massage chair is provided for being interchangeably used as a seating support and a massaging platform. Above the conventional components of an advanced chair construction such as a horizontal base with a number of casters for slidably supporting the base over the floor, an upholstered seat bottom and seatback assembled to the base through a telescopic upright stand for a height adjustment from the base, the invention provides pairs of elongated cushion flaps pivotally attached to the seat bottom and seatback for selectively providing an extra cushion to the seated user on the respective seating surfaces. Each flap is shaped to flap on a bi-level pivot action to cover or expose an underlying massage surface of the chair with the assistance of a toggle action in order to facilitate the change of the mode of operation of the chair.

8 Claims, 4 Drawing Sheets

MULTIPLE MODE MASSAGE CHAIR

BACKGROUND OF THE INVENTION

A. Field of the Invention

The present invention relates to furniture. More particularly, the present invention relates to a chair with two interchangeable modes of operation between an ergonomic seat and a massaging platform.

B. Discussion of Related Art

Chairs are structured to support human body in motion or at rest comfortably and their detailed designs are classified to fit various seating environments like an office for work, an automobile for travel or a lounge. On top of the ordinary seating functions, chairs began to employ electric massaging devices in and around the seat backs and/or bottoms of the chairs to revitalize men and women from long hours of hard work. Such devices may be installed inside the chair structure or separately retrofitted thereto. Internal massage units may have a frame for movably supporting massage rollers or nodes powered by motors through a transmission mechanism under a programmed control to perform a kneading massage, acupressure or rolling massage on the posterior side of the occupant. One of the practical massage chair structures is found in U.S. Pat. No. 6,629,939 the disclosure of which is incorporated herein by reference. An exemplary portable body massager is disclosed in U.S. Pat. No. 7,128,721 the disclosure of which is incorporated herein by reference.

To deliver the effective massage pressures, the massaging interface of the massage unit is normally lightly padded or simply visually blocked. Normally the massaging interface presses against the occupant's body areas of spine, lumbar, buttocks and pelvic bones by his or her weight. Before and after the relatively short massaging sessions the chair also needs to provide a good cushioning function via a certain amount of upholstery. A user may solve the problem by adding a small pillow or by draping a towel over the massaging interface of the chair massager or portable massager so that the user may change the surface of the seating area every time the chair switches between the massaging mode and the supporting mode. This is awkward though.

It is therefore, an object of the present invention to provide a set of integrated cushion members to convert the massage unit interface of the massage chair from a massager mode to a seating mode and vice versa without using unsightly or unbalancing accessories to the chair.

Another object of the invention is to provide two distinctive chair modes of bodily support and therapeutic massager based on a single compact chair.

Yet another object of the present invention is to provide a simple chair conversion means for reconditioning the chair cushion between its seating mode and massager mode whether the massager is an onboard type or portable device mounted on the chair.

SUMMARY OF THE INVENTION

To provide the dual mode of operation in a single seat, the present invention has a user-configurable cushion preferably fabric joined for flip open mechanical connection to chair upholstery.

A two-mode massage chair of the present invention generally comprises a horizontal base supporting the entire chair on a number of casters, a seat bottom attached to the base through an upright stand, a couple of arm rests and a contoured seatback both supported by the stand. On top of the chair is a headrest, which may be a separate member mounted to the chair or an extension of a top central portion of the seatback to support the occupant's head.

The chair also has at its side edges a front surface with two opposing protrusions or bolsters provided for cradling the sides of the occupant's back torso. The bolsters may be separately covered by the fabric, leather or similar material as used for the front seating surface and may be stitched to the same surface along contoured indentations.

Over the bolsters there are provided pea pod shaped flaps each being held along a section of the indentation between the seatback portions in a toggle-action mechanism. Either flap is shaped in the mirror image of the other and upholstered using the same material so that the opposite faces of a single flap may be consistent and a single design commonly makes up either side flap to keep the manufacturing of the chair economical. In this embodiment, the flap is filled with a padding to provide a cushion to compensate the lack of softness of the front seating surface, which should permit thrusts of the massaging head of the unit delivered to the occupant with less dampening.

In addition, the flap has a proximal side generally divided into a first lump spanning about top one third of the length of the flap, a second lump at a bottom one third of the length of the flap and a middle recess that connect the two lumps. The flap has a slightly arched distal side so that when both side flaps are flipped open the distal sides approximately coincide with the corresponding side edges of the seatback while the distal sides faces each other in a close proximity or meet together along a longitudinal centerline of the seatback.

The main area of the flap is generally shaped like an oversized pea pod to support approximately a half side area of the occupant's posterior including the torso and lower back. Depending on the specific chair design, the top protrusion is optional and the flap may be shaped to have a plain top in case the headrest of the chair is omitted or free of a massaging source.

In operation of the flap on the chair surface, the lumps become pushed aside whenever the occupant moves the flap to either side for a change of the chair mode providing a toggle-flip action. Because either side pivot is virtually positioned at a location beyond the anchor pivot into a depth of the seatback the flap is forced to lie flat on the seatback whenever the user pulls the flap and deflect it the opposite side overcoming the resistance of the lumps against the front seating surface.

The bottom flaps for the seat bottom may be made and installed in the method described above for the flap to provide the similar functions to the lower seating areas of the occupant.

In a second embodiment of the invention the chair has three sets of flap pairs for independent manipulations by hands to toggle between the respective inside and outside of the massaging regions of the chair.

Embodiments of the invention will now be described by way of example with reference to the accompanying drawings.

BRIEF DESCRIPTION OF THE DRAWINGS

Similar reference numbers denote corresponding features throughout the attached drawings.

DETAILED DESCRIPTION OF THE PREFERRED EMBODIMENT

Figure 1:
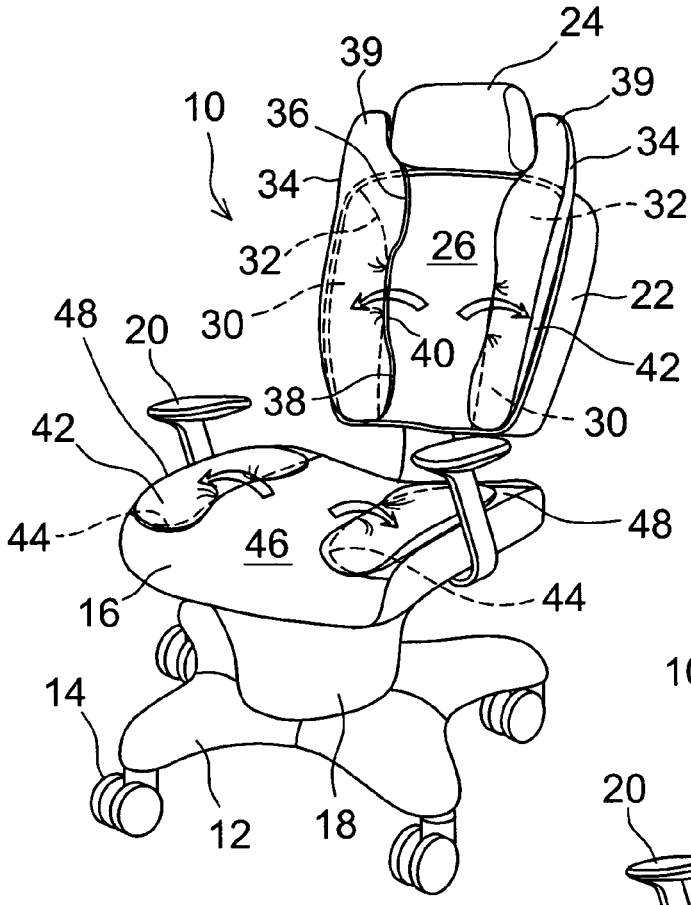
FIG. 1 is a perspective view of a two-mode massage chair in a massager mode according to a first embodiment of the present invention.

With reference to FIG. 1, a two-mode massage chair of the present invention is generally designated by 10 and comprises a horizontal base 12 supporting the entire chair 10 on a number of casters 14, a seat bottom 16 attached to the base 12 through a telescopic upright stand 18 for a height adjustment from the base 12, the seat bottom a couple of arm rests 20 and a contoured seatback 22 both supported by the stand 18. On top of the chair 10 is a headrest 24, which may be a separate member mounted to the chair 10 or an extension of a top central portion of the seatback 22 to support the occupant's head.

The overall seating surfaces of the chair 10 may be conventionally upholstered. Specifically, the seatback 22 has a front seating surface 26 of a fabric, leather or similar material that thinly covers an electrical massaging unit 28 installed in the cavity of the seatback 22 as shown schematically in FIG. 3. At side edges of the front surface 24 two opposing protrusions or bolsters 30 are provided for cradling the sides of the occupant's back torso. The bolsters 30 may be separately covered by the fabric, leather or similar material as used for the front seating surface 26 and may be stitched to the same surface 26 along contoured indentations 32.

Over the bolsters 30 there are provided pea pod shaped flaps 34 each being held along a section of the indentation 32 between the seatback portions 26 and 30 in a toggle-action mechanism as will be further detailed below. Either flap 34 is shaped in the mirror image of the other and upholstered using the same material so that the opposite faces of a single flap 34 may be consistent and a single design commonly makes up either side flap 34 to keep the manufacturing of the chair 10 economical. In this embodiment, the flap 34 is filled with a padding to provide a cushion to compensate the lack of softness of the front seating surface 26, which should permit thrusts of the massaging head of the unit 28 delivered to the occupant with less dampening. In any case, the exact mechanical configuration for the massaging units is well known in the art and has been discussed in a wide variety of patents. The preferred massaging unit is the standard rotating roller head that is commonly and commercially available in many units currently on the market. Any number of roller head units can be used. The mechanical configuration can be configured according to customers needs.

Figure 2:
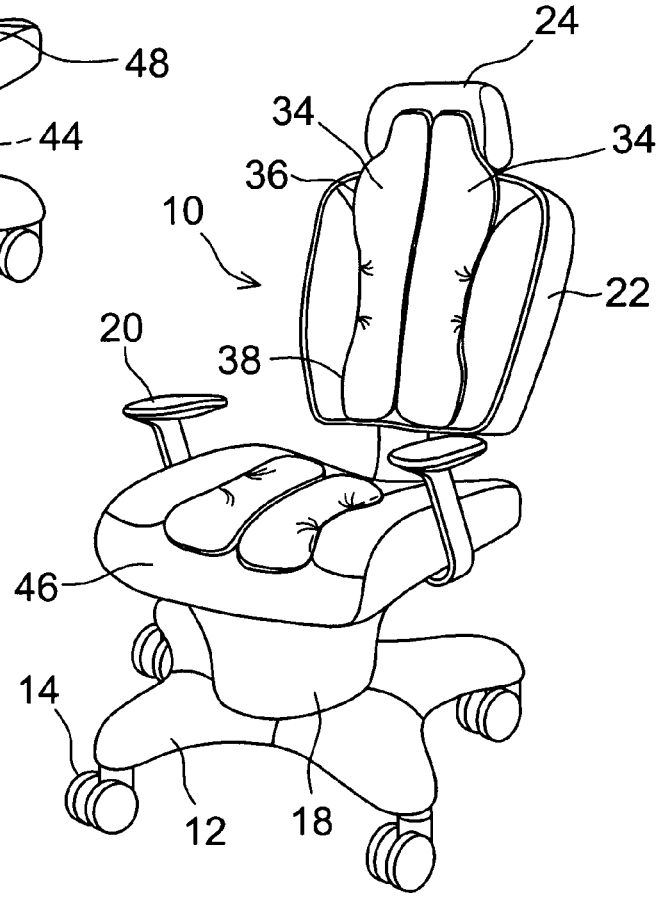
FIG. 2 is a perspective view of the two-mode massage chair of FIG. 1 in a seating mode.

In addition, the flap 34 has a proximal side generally divided into a first lump 36 spanning about top one third of the length of the flap 34, a second lump 38 at a bottom one third of the length of the flap 34 and a middle recess 40 that connect the two lumps 36, 38. The flap 34 has a slightly arched distal side 42 so that when both side flaps 34 are flipped open the distal sides 42 approximately coincide with the corresponding side edges of the seatback 22 as shown in FIG. 1 while the distal sides 42 faces each other in a close proximity or meet together along a longitudinal center line of the seatback 22 as shown in FIG. 2. FIG. 2 depicts the same chair 10 as in FIG. 1 with its configuration changed into the seating mode of operation.

In case the headrest 24 also provides the massaging extended to the head of the occupant, the flap 34 may also have a top protrusion 39 that is shaped to conform to the lateral contour of the headrest 24 when the flap 34 is positioned at rest as in FIG. 1 illustrating the massaging mode of operation. To the contrary, when the chair 10 returns to the seating mode where the additional cushion is created by the two flaps 34 flip closed, the top protrusions 39 of the flaps 34 follow suit to cushion an effective head support area of the headrest 24 as in FIG. 2.

Similarly, the seat bottom 16 may have two independent bottom seat flaps 42, which are pivotally attached to indentations 44 between a bottom seating surface 46 in the center of the seat bottom 16 and two lateral bottom bolsters 48 formed integral to the seat bottom 16.

Figure 3:
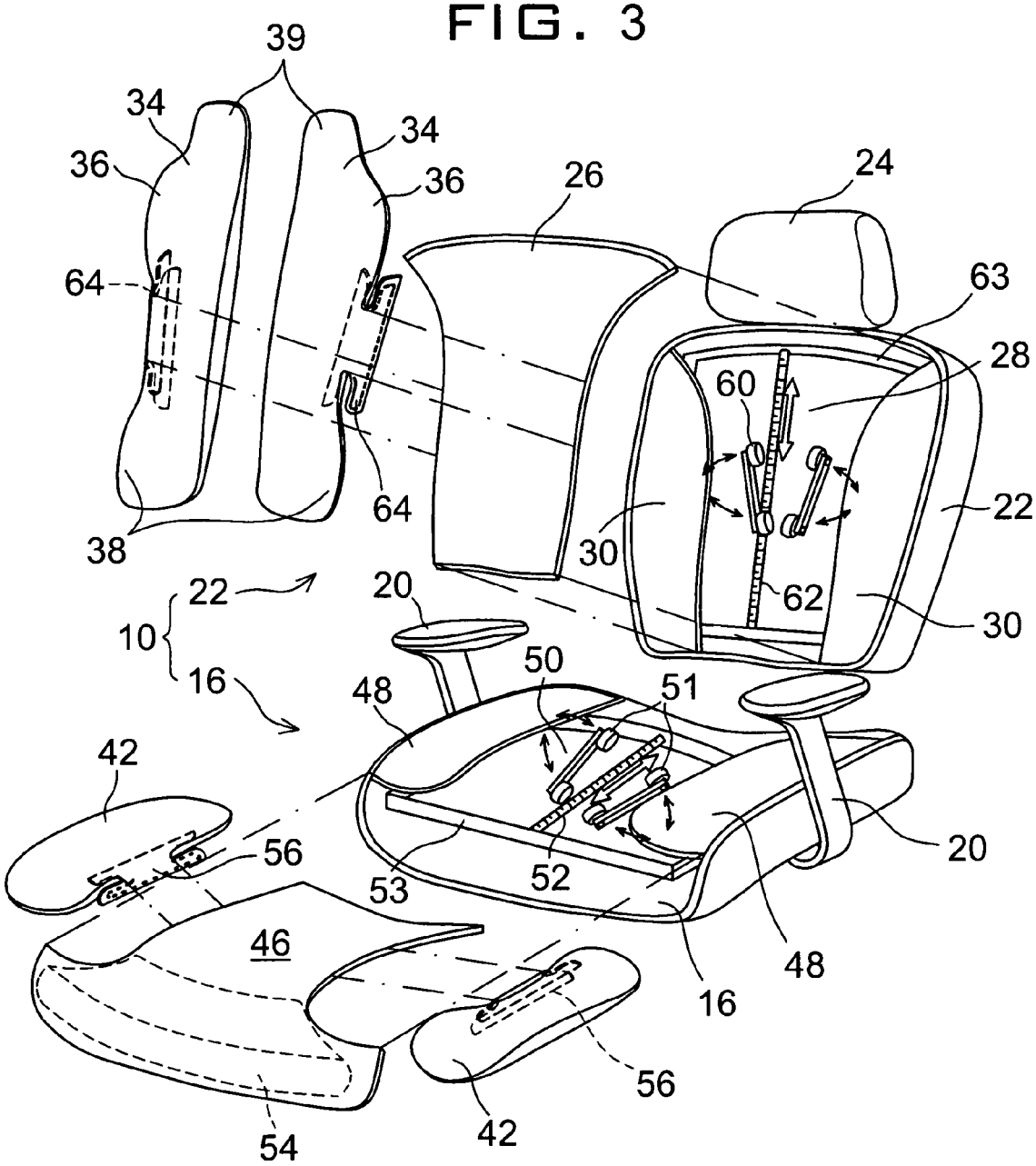
FIG. 3 is an exploded perspective view of the massage chair of FIG. 1 showing the primary subassemblies with the supporting base omitted.

FIG. 3 is a partial exploded view of the main components of the two-mode massage chair 10 comprising at its seat base the seat bottom 16 caging a framed massage unit 50 having vibrating pressure rollers 51 traveling along a track 52 in a frame 53 by a motor and transmission mechanism not shown and two padded bottom bolsters 48, the bottom seating surface 46 which may be cushioned by an internal foam block 54, the two padded bottom flaps 42 each having a flexible hinge 56 with a reinforcement for pivotally attaching the flap 42 to the junction between the seating surface 46 and two bolsters 48, and a pair of armrests 20 attached to both sides of the seat bottom 16.

The chair 10 comprises at its backrest area the seatback 22 enclosing a back massage unit 58 with vibrating rollers 60 raised or descended along a track 62 in a fame 63 by a motor and transmission device not shown and two side bolsters 30 padded with foam blocks shaped to fit the covering at 30 of leather, fabric or vinyl, the front seating surface 26 to cover the cavity of the seatback 22 between the bolsters 30, the two padded side flaps 34 each having a flexible hinge 64 with a reinforcement for pivotally attaching the flap 34 to the junction at mid-level between the seating surface 26 and two bolsters 30, and a top headrest 24 that may be movably attached for a height adjustment to the individual occupant's head.

Figure 4:
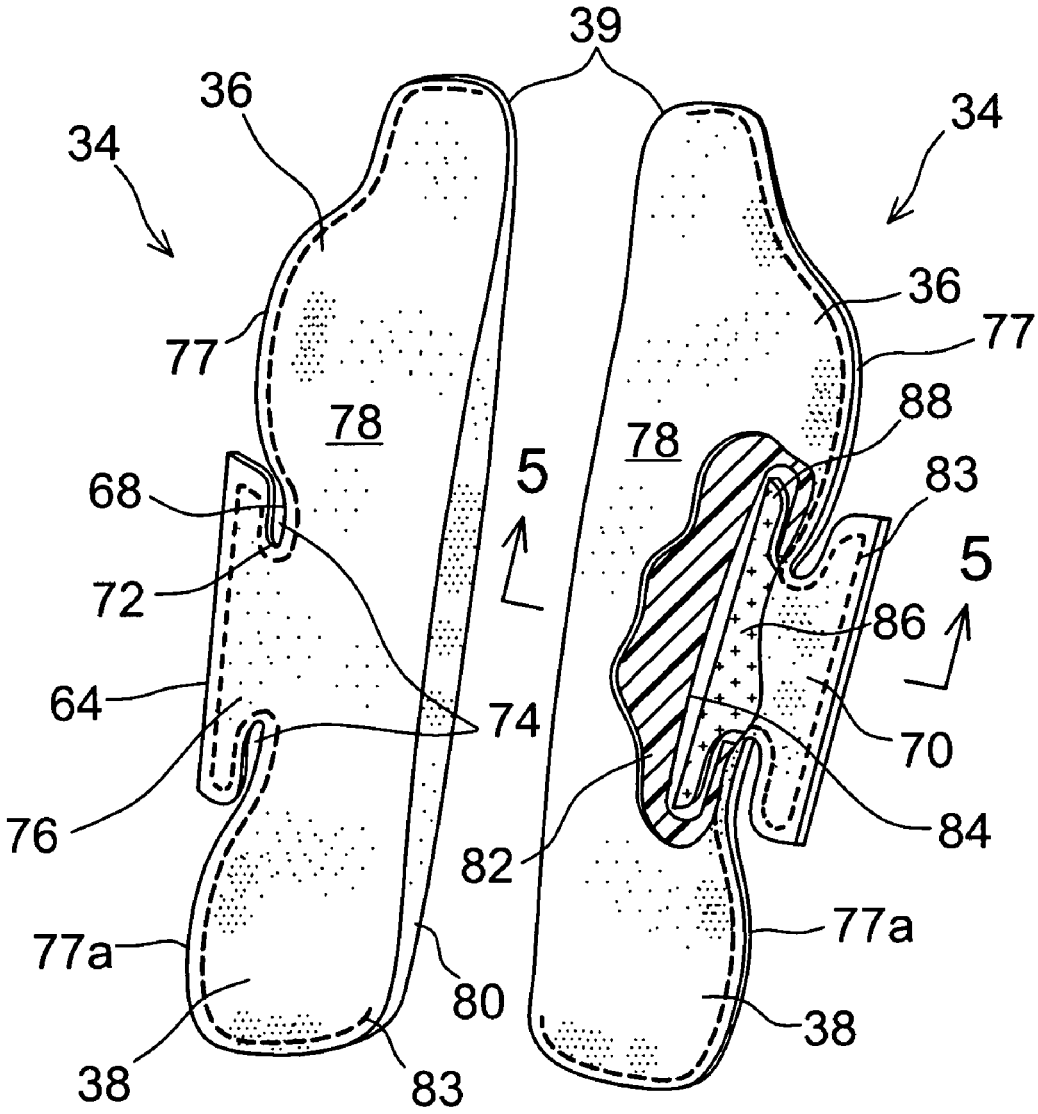
FIG. 4 is a detailed perspective view of the auxiliary toggle bolsters of FIG. 3 with a partial cut away view of the interior of the bolster.

Referring to FIG. 4, a possible construction and function of the cushion flaps 34 will be described. The main area of the flap 34 is generally shaped like an oversized pea pod to support approximately a half side area of the occupant's posterior including the torso and lower back. Depending on the specific chair design, the top protrusion 39 is optional and the flap 34 may be shaped to have a plain top in case the headrest of the chair is omitted or free of a massaging source.

Between the first and second lumps 36, 38 there is positioned a deep recess 68 of the flap 34 from which the integral hinge 64 extends with a neck portion 72 defined by a clearance 74 between the hinge 64 and the main flap area. The hinge 64 provides an anchor pivot 76 once the hinge 64 is fastened with the neck portion 72 tied down under the front seating surface 26 in the assembly of the chair 10 shown in FIG. 3. Similarly, the peak of the lumps 36, 38 provide side pivots 77 and 77*a* about which the flap 34 swivels in two opposite directions.

For each flap 34, two identical sheet sections in a symmetrical shape may provide its exterior surfaces 78. The flap sheet may be folded along its center at a flat elongated area 80 over a foam core 82, which is generally shaped into the main body of the flap 34 providing the desired cushion effect. The sheet sections may be glued and sewn together along a stitch line 83.

In operation of the flap 34 on the chair surface 26, the lumps 36, 38 become pushed aside whenever the flap 34 changes the side and mode providing a toggle-flip action. Because either side pivot 77 or 77*a* is virtually positioned at a location beyond the anchor pivot 76 into a depth of the seatback 22 the flap 34 is forced to lie flat on the seatback 22 whenever the user pulls the flap 34 and deflect it the opposite side overcoming the resistance of the lumps 36, 38 against the front seating surface 26. This built-in toggle action through the bi-level pivot saves an extra fastening means to hold the flap 34 in a stable posture in either mode of the chair operation.

Figure 5:
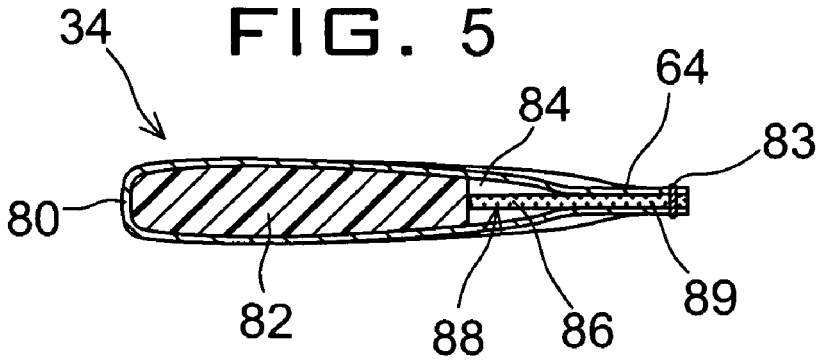
FIG. 5 is a cross sectional view of one of the toggle bolsters taken along line 5-5 of FIG. 4.

Further referring to FIG. 5, the foam core 82 and thus the surface of the flap 34 may have any desired topography to comfortably cushion the posterior of the occupant. In the simplified embodiment as illustrated, middle of the flap 34 near the distal edge at the area 80 has a predetermined thickness as it becomes gradually thinner toward the remaining edges including the opposite proximal edge at the hinge 64 as well as the top protrusion 39. The foam core 82 may be terminated short of the neck portion 72 of the hinge 64 and cut out to have a large slot or bay 84 for receiving a reinforcement member 86. The member 86 may be an elastic plate in the shape of H with a leg 88 held in the bay 84 of the foam core 82 while the other leg 89 extends into the cavity of the sheet area at the hinge 64 thereby making the hinge 64 flexible but durable over the expected life of the chair 10. Alternatively, the foam core 82 may extend into the hinge area to replace the extra reinforcement member 86.

The bottom flaps 42 for the seat bottom 16 may be made and installed in the method described above for the back flap 34 to provide the similar functions to the lower seating areas of the occupant.

Figure 6:
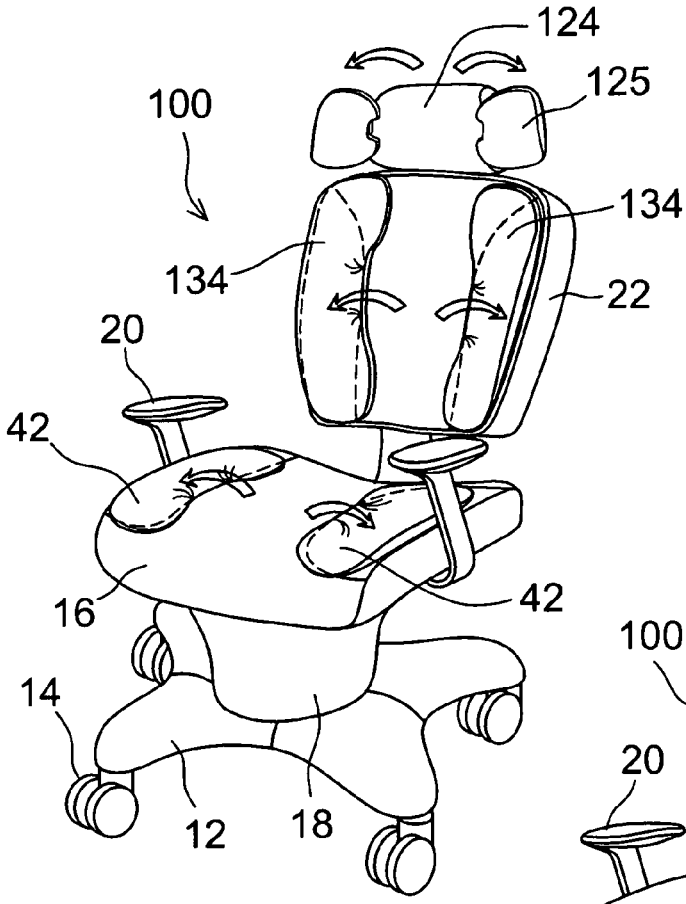
FIG. 6 is a perspective view of a two-mode massage chair in a massager mode according to a second embodiment of the present invention.
Figure 7:
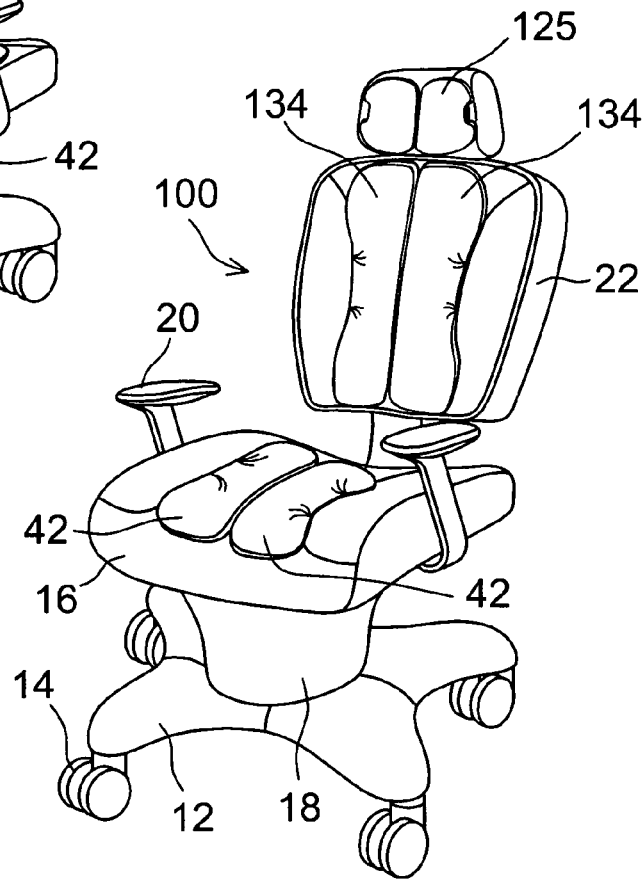
FIG. 7 is a perspective view of the two-mode massage chair of FIG. 6 in a seating mode.

Referring to FIGS. 6 and 7 of a second embodiment where a chair 100 has three independent parts with massaging as well as seating functions, the operation of the invention will be described. The corresponding portions of the chair 100 to the chair 10 are designated with the same reference numbers. The chair 100 is provided with a massaging headrest 124 exclusively having two side flaps 125, the detailed structure of which is principally same as the flap 34 in FIG. 4 in the first embodiment except the outer profile that conforms to approximately half the front area of the headrest 124. A seatback 122 has two side flaps 134 shaped correspondingly within the periphery of the seatback 122.

In operation, three sets of flap pairs 125, 134, 42 may be independently manipulated by hands to toggle between the respective inside and outside of the massaging regions.

Therefore, while the presently preferred form of the massaging chair has been shown and described, and several modifications thereof discussed, persons skilled in this art will readily appreciate that various additional changes and modifications may be made without departing from the spirit of the invention, as defined and differentiated by the following claims.

The dynamically cushioned chair of the present invention is also adaptable to work with a portable massage pad that extends at least part of the seating surface of the chair. As with the on-board type of massage unit, the flap pairs may be toggled onto and away from the stimulating surfaces of the massager to provide a swift change between the massage mode and the comfortable support mode over the single chair.

The foregoing describes the preferred embodiments of the invention. Modifications may be made without departing from the spirit and scope of the invention as set forth in the following claims. The present invention is not limited to the embodiments described above, but encompasses any and all embodiments within the scope of the following claims. For example, the flap of the present invention may be integrated into the upholstery of a vehicle chair with a massaging option.

The invention claimed is:

1. A chair for use as a seat and a massager comprising:

a. a horizontal base;

b. a seat bottom connected to the base, the seat bottom having a soft seating surface;

c. a seatback fixed to the seat bottom and having a front seating surface for supporting a seated user's upper torso;

d. a seat back cavity formed in the seatback and holding a massaging unit; and at least one cushion flap removably attached to the seatback cavity for selectively providing extra cushion between the seatback cavity and massaging unit in a seat mode when the seat back cavity and massaging unit are covered by the cushion flap, whereby the flap can add or subtract cushion to and from the front seating surface wherein the cushion flap has a hinged connection to the seatback and has a proximal edge with its middle portion recessed and attached to the front seating surface so that the rest of the proximal edge of the flap is normally pushed by the front seating surface to keep the flap laid flat before and after its pivotal movement into either a first inactive position away from the central area of the front seating surface but close to the periphery of the seatback or a second active position superimposing substantially half the central area of the front seating surface.

2. A chair for being interchangeably used as a seating support and a massaging platform comprising:

a. a horizontal base;

b. a seat bottom assembled to the base through an upright stand, the seat bottom having soft seating surfaces for supporting a seated user longitudinally;

c. a seatback fixed to the assembly of the seat bottom and upright stand and having front seating surfaces for supporting the seated user's upper torso; and d. a pair of elongated cushion flaps pivotally attached to the seatback for selectively providing an extra cushion to the seated user on the respective front seating surfaces.

3. The chair of claim 2, wherein each flap has a proximal edge with its middle portion recessed and attached to the front seating surfaces so that the rest of the proximal edge of the flap is normally biased by the front seating surfaces to keep the flap flat before and after its pivotal movement into either a first inactive position away from the central area of the respective front seating surfaces but close to the periphery of the seatback or a second active position superimposing substantially half the central area of the front seating surfaces, whereby the opposing flaps in a pair can add or subtract cushion to and from the respective front seating surfaces of the seatback in a toggle action.

4. The chair of claim 2, further comprising an internal massaging unit installed in the seatback, the massaging unit having massaging heads traveling along a track in a frame by an electric motor and transmission mechanism so that roller movements of the massaging heads may be delivered only through the front seating surfaces to the seated user with the pairs of cushion flap occupying a first inactive position.

5. The chair of claim 3, wherein each of the flaps comprises a core padding shaped to comfortably cushion the posterior of the seated user when their distal edges opposite from the proximal edges conjoin in the second active position, two symmetrical covering sections joined along a center area in a symmetrical shape, the covering sections being folded over the core padding and glued and sewn together, and an integral flexible hinge with a pivot line retreated toward the center of the flap at the recessed middle portion of the proximal edge, the hinge being reinforced either by an extension of the core padding or an extra elastic plate mated with a portion of the core padding to maintain the hinge flexible.

6. A chair for being interchangeably used as a seating support and a massaging platform comprising:

a. a horizontal base with a number of casters for slidably supporting the base over the floor;

b. a seat bottom assembled to the base through a telescopic upright stand for a height adjustment from the base, the seat bottom having soft seating surfaces for supporting a seated user longitudinally;

c. a seatback fixed to the assembly of the seat bottom and upright stand and having front seating surfaces for supporting the seated user's upper torso;

d. a headrest mounted on top of the seatback having front seating surfaces, the headrest being adjustable in its height to the individual seated user and e. two pairs of elongated cushion flaps pivotally attached to the seat bottom and seatback for selectively providing an extra cushion to the seated user on the respective seating surfaces, each flap having a proximal edge with its middle portion recessed and attached to the seating surfaces so that the rest of the proximal edge of the flap is normally pushed by the seating surfaces to keep the flap lie flat before and after its pivotal movement into either a first inactive position away from the central area of the respective seating surfaces but close to the periphery thereof or a second active position superimposing substantially half the central area of the respective seating surfaces, whereby the opposing flaps in a pair can add or subtract cushion to and from the seating surfaces of the seat bottom and seatback in a toggle action.

7. The chair of claim 6, further comprising an internal massaging unit installed in each of cavities of the seat bottom and seatback the massaging unit having vibrating pressure rollers traveling along a track in a frame by an electric motor and transmission mechanism so that roller movements of the vibrating pressure rollers may be delivered only through the seating surfaces to the seated user with the pairs of cushion flap occupying the first inactive position.

8. The chair of claim 6, wherein each of the flaps comprises a core padding shaped to comfortably cushion the posterior of the seated user when their distal edges opposite from the proximal edges conjoin in the second active position, two identical covering sections joined along a center area in a symmetrical shape, the covering sections being folded over the core padding and glued and sewn together, and an integral flexible hinge with a pivot line retreated toward the center of the flap at the recessed middle portion of the proximal edge, the hinge being reinforced either by an extension of the core padding or an extra elastic plate mated with a portion of the core padding to maintain the hinge flexible.

* * * * *